United States Patent [19]

Noeske

[11] 4,339,641

[45] Jul. 13, 1982

[54] NOZZLE FOR A PUFFER-TYPE CIRCUIT BREAKER

[75] Inventor: Heinz O. Noeske, Cherryhill, N.J.

[73] Assignee: General Electric Company, Schenectady, N.Y.

[21] Appl. No.: 153,580

[22] Filed: May 27, 1980

[51] Int. Cl.[3] ..... H01H 33/70

[52] U.S. Cl. ..... 200/148 R; 200/148 A

[58] Field of Search ..... 200/148 A, 148 R

[56] References Cited

U.S. PATENT DOCUMENTS

| | | | |
|---|---|---|---|
| 3,670,124 | 6/1972 | Teijiero | 200/148 A |
| 3,739,125 | 6/1973 | Noeske | 200/148 A |
| 4,161,636 | 7/1979 | Maier | 200/148 A |

*Primary Examiner*—Robert S. Macon

*Attorney, Agent, or Firm*—Lawrence D. Cutter; James C. Davis, Jr.; Marvin Snyder

[57] ABSTRACT

A puffer-type circuit breaker is provided with a nozzle of insulating material having a section downstream of the nozzle throat designed to optimize arc cooling by a high speed flow of insulating gas passing over the arc. The nozzle design prevents excessive ablation of nozzle material by the arc and reduces blocking of the nozzle by the moving electrode during circuit interruption. The nozzle includes a generally conically-shaped upstream section, a throat section and a generally bell-shaped downstream section.

6 Claims, 7 Drawing Figures

NOZZLE FOR A PUFFER-TYPE CIRCUIT BREAKER

BACKGROUND OF THE INVENTION

The instant invention relates to a circuit breaker of the puffer type, and more particularly, to a puffer breaker having a nozzle designed to maximize arc cooling by a high speed flow of insulating gas therethrough.

During circuit interruption by a puffer breaker, an arc is drawn between the breaker contacts. The arc is cooled by adiabatic compression of insulating gas in a puffer assembly during breaker opening, as the insulating gas is blown over the arc to cool the arc. In puffer breakers employing a slowly expanding nozzle of insulating material, application to high current circuit interruption results in excessive ablation of the nozzle material, which clogs the nozzle throat, and blocking of the insulating gas flow by the movable electrode passing through the nozzle throat of the type having small expansion angle. These results increase the time required for deblocking the circuit breaker nozzle, when the arc current approaches zero, thereby increasing the circuit interruption time lapse.

One prior art approach to improving interruption characteristics has been to provide a downstream electrode substantially smaller than the nozzle throat diameter. Such a configuration allows a significant portion of the insulating gas to escape through the nozzle throat prior to current zero, resulting in a lower gas pressure and reduced arc interruption capability of the insulating gas at the critical moment of current zero.

An alternative approach to overcoming the problem of ablation is to employ a very short downstream nozzle section having the characteristics of essentially an orifice. Such a construction reduces the nozzle ablation and blocking of the flow by the moving electrode, but diminishes the thermal interruption performance of the insulating gas flowing over the arc downstream of the nozzle throat, since it does not confine the flow downstream of the nozzle throat.

SUMMARY OF THE INVENTION

An object of the instant invention is to configure an insulating nozzle for a puffer breaker, such that ablation of the nozzle material and blocking of gas flow through the nozzle throat are minimized, and thermal recovery capability is maximized. A more specific object of the instant invention is to design a nozzle for a puffer breaker having a generally bell-shaped section extending downstream from the nozzle throat, such that thermal recovery capability is optimized.

Accordingly, the instant invention provides a puffer-type gas blast circuit breaker with a pair of separable contacts movable relative to each other from abutting engagement to a separated position at which an arc is established between the contacts and a nozzle of electrically-insulating material having a generally conical inlet section, a throat having an internal diameter approximately equal to the outside diameter of the contact which passes through the throat, and a generally bell-shaped section extending downstream of the throat, which defines a rapidly expanding section which merges into a flow-confining section, and a gas compression device for forcing a high velocity flow of insulating gas through the nozzle, such that the gas flows first through the inlet section then through the throat and passes out through the bell-shaped section surrounding the arc during an arc interrupting operation

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
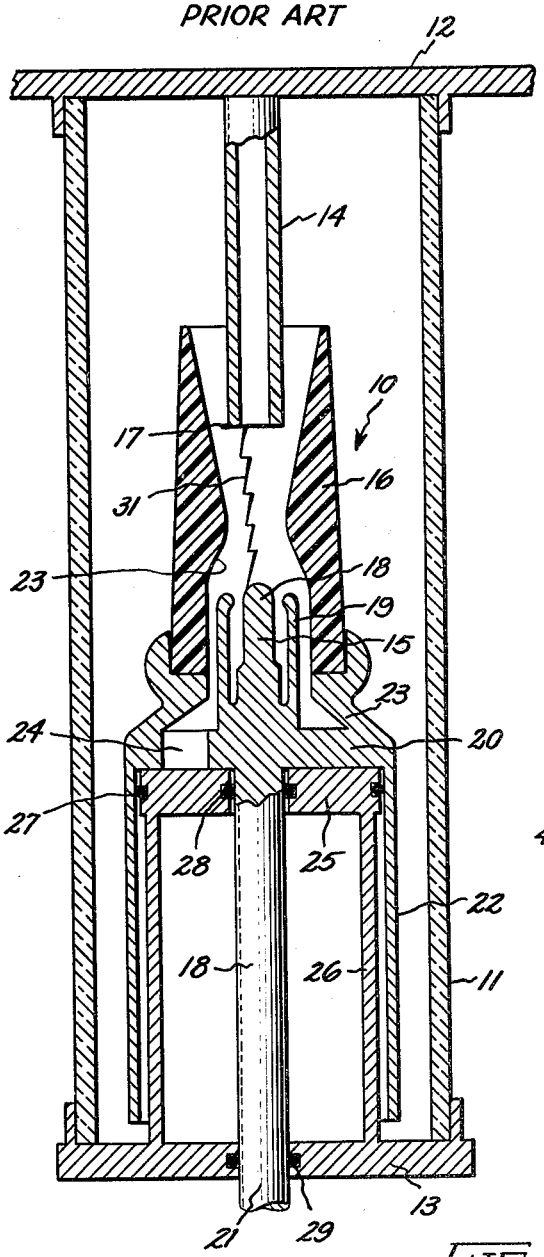
FIG. 1. PRIOR ART
FIG. 1 is a schematic partial cross-sectional view of a circuit interrupter having a slowly expanding nozzle.

The specific manner and process of making and using the instant invention and the specific features thereof described herein and shown in FIGS. 1–7 are merely exemplary, and the scope of the instant invention is defined in the appended claims. Throughout the description and FIGS. 1–7, like reference characters refer to like elements of the invention.

FIG. 1 illustrates a conventional puffer breaker 10 in which a cylindrical casing 11 of an insulating material (e.g., plastic) and end members 12 and 13 of metallic material provide a sealed enclosure. Puffer breaker 10 includes fixed contact means 14 and movable contact means 15 having nozzle 16 attached thereto. Fixed contact means 14 comprises a cylindrical hollow member having a tip 17 made of materials, such as copper-tungsten, which are able to withstand the heat generated by an arc drawn between the contacts at an interruption operation. Contact means 15 comprises centrally-disposed arcing electrodes 18 and concentrically-disposed contact fingers 19 which carry the current when the breaker is in the "closed" normal load carrying position. Contact means 15 is mounted on an end wall 20 connected to an actuating rod 21, to which a cylindrical wall 22 is attached and to which a shoulder 23 for supporting nozzle 16 is also mounted. End wall 20 has a plurality of circumferentially-spaced openings 24 therein. Disposed within annular wall 22 is an annular piston 25 mounted upon a cylindrical sleeve 26 affixed to the end wall 13. Appropriate seals 27, 28, 29 are provided to seal the enclosure. Upon receiving an interrupting control signal from a conventional control device (not shown), actuating rod 21 is moved axially downwardly by conventional actuating means (not shown) thereby moving contact means 15 and cylindrical wall 22 downwardly causing a flow of insulating gas normally stored between the end wall 20 and annular piston 25 through passage 24 to flow past movable contact means 15 through the nozzle throat 30 over an arc 31 formed between contacts 14 and 15 during the interrupting operation.

Figure 2:
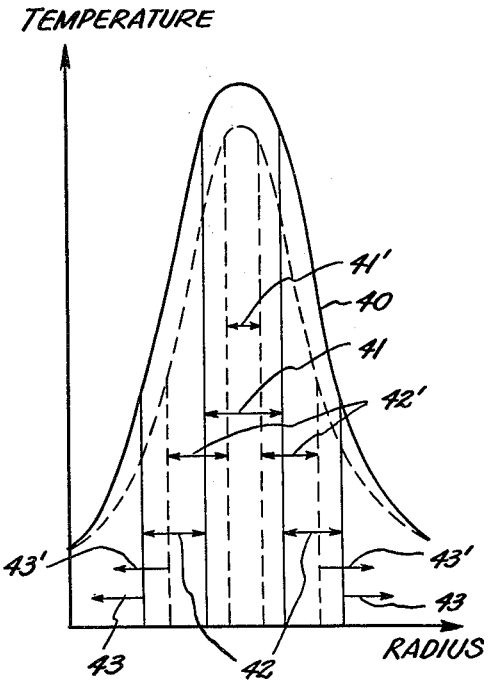
FIG. 2 is a representative temperature distribution at the entrance of a nozzle expansion area a short time before current zero following separation of breaker contacts.

If a molecular insulating gas, such as sulfur hexafluoride, $SF_6$, is employed as the arc extinguishing medium, the temperature characteristic 40 of the arc zone just downstream of the nozzle throat may be divided into three radial temperature zones as shown in FIG. 2. In zone 41, the central core, the temperature of the gas due to arc heating is so high that the molecular gas is completely dissociated and highly conductive. This central core represents the current-carrying zone, where ohmic heating of the gas occurs by passage of the arc current therethrough. Zone 42 is an annular cylindrical region surrounding zone 41 in which dissociation may be negligible, but the temperature is still sufficiently high that the gas exists in its dissociated state. Zone 43 is another annular region surrounding zone 42, in which the temperature is sufficiently low that the gas is completely recombined into molecules. If we consider only adiabatic expansion cooling during arc interruption, as the gas proceeds downstream in the nozzle, and neglecting all other loss mechanisms including radiation, conduction and conversion energy transfer or ohmic heating, the temperature of the gas will drop in all three zones, causing the boundaries between zones 41 and 42 and between zones 42 and 43 to move radially inwardly, as shown in broken lines and primed reference characters in FIG. 2. This reduces the cross-sectional area of the central core, zone 41', in which gas is dissociated and electrically conducting, and simultaneously establishes a new temperature distribution for radial thermal conduction. During actual arc interruption, ohmic heating would occur within zone 41, tending to expand the cross section of zones 41 and 42, and the energy added by ohmic heating would counteract the energy loss of which adiabatic cooling is a part. Then, for a given rate of rise of recovery voltage, successful arc interruption depends upon whether ohmic heating is a stronger process than the combination of energy loss mechanisms.

To analyze arc cooling in a puffer breaker, the conditions in the inlet and throat areas of a nozzle in which the static gas pressure is typically 100 to 300 psig are considered first. Generally speaking, the higher the gas pressure the more efficient is the arc cooling by the gas flowing over the arc. The significant parameters effecting the efficiency of arc cooling in this area are energy extraction due to diffusion (i.e., thermal conduction of kinetic and reaction energy), convective and radiative energy transfer. In the expanding, downstream section of the nozzle, where static gas pressure is typically 45–75 psig, these processes may lose their effectiveness, since the effectiveness of each of these cooling mechanisms decreases as gas pressure decreases. Therefore, in this region of low gas pressure, plasma cooling by adiabatic flow expansion accounts for most of the arc cooling.

Figure 3:
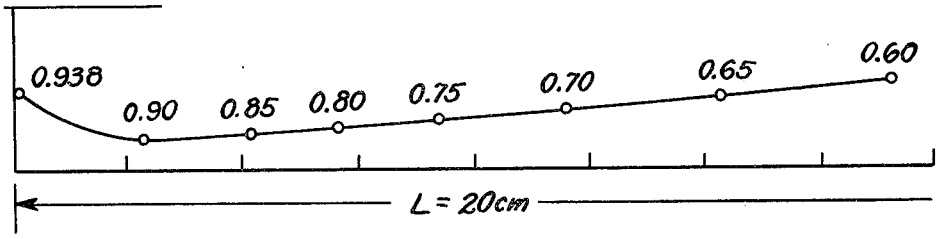
FIG. 3 is a graphical representation of recombination rate for a particular molecular gas in the nozzle of FIG. 1.

If the cooling medium is assumed to be a diatomic molecular gas, and if it is assumed that recombination of the dissociated gas by adiabatic expansion cooling in the nozzle is the only cooling mechanism, the rate of recombination of atoms depends upon the temperature and the mole density of atomic and molecular particles within the expanding gas. FIG. 3 shows the percentage of gas recombined relative to length for a conventional linearly, slowly expanding nozzle 16 as shown in FIG. 1. The fraction of dissociated gas decreases slowly along the nozzle. The recombination rate for a diatomic gas can be written $$\rho \frac{d}{dt}\left(\frac{[x_2]}{\rho}\right) = -\rho \frac{d}{dt}\left(\frac{[x]}{\rho}\right) = [Z]\,\{K_f[x]^2 - K_b[x_2]\}$$

where t = time, [x] = mole density of atoms x, $[x_2]$ = mole density of molecules $x_2$, [Z] = total mole density, $K_f$ = the coefficient of forward reaction, $K_b$ = coefficient of backward reaction, $\rho$ = mass density. The equation states that the recombination rate, i.e., recombination of atoms x to molecules $x_2$ for a given time increment, increases as gas pressure represented by total mole density [Z] increases, and increases as the amount the state of the gas deviates from equilibrium at a particular time t (represented by the expression between the braces on the right side of the equation). It will be observed that the conditions represented by the equation have opposing requirements; while fast nozzle expansion would bring the state of the gas away from equilibrium, it will also rapidly reduce the gas pressure. Although this discussion is addressed to recombination of atoms to molecules, a similar mechanism is applicable for explanation of recombination of electrons and ions.

In order to reduce the number of moles of atomic gas per gram of insulating gas from the value $n_{xo}$ at the nozzle throat to a specified level $n_{xe}$, the nozzle length L downstream of the nozzle throat is required according to the following equation:

$$L = \int_{n_{xe}}^{n_{xo}} \frac{dn_x}{2r}$$

wherein r is the local recombination rate per unit nozzle length given by:

$$r = \frac{d}{dx}(n_{x2}) = -\tfrac{1}{2}\frac{d}{dx}(n_x).$$

The minimum length $L_{min}$ required for reducing $n_{xo}$ to $n_{xe}$ can be determined by variation of the integral, above.

Figure 4:
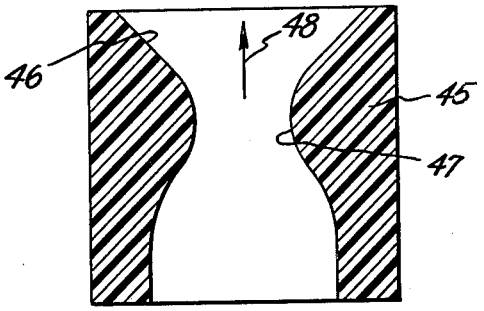
FIG. 4. PRIOR ART
FIG. 4 is a schematic partial cross-sectional view of a rapidly expanding nozzle.
Figure 5:
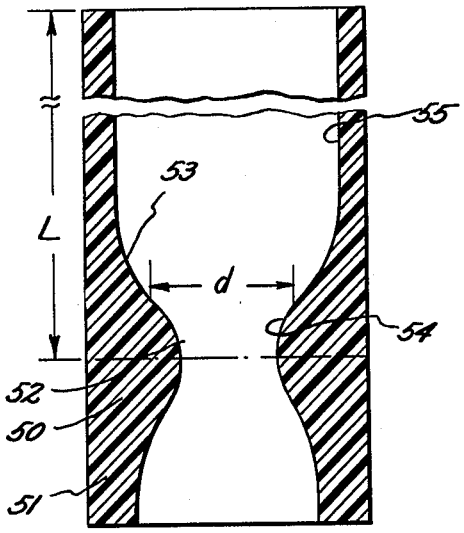
FIG. 5 is a schematic partial cross-sectional view of a nozzle for a circuit interrupter designed according to the instant invention.

One prior art attempt to maximize adiabatic cooling, shown in FIG. 4, involves the use of a nozzle 45 having a portion 46 downstream of the nozzle throat 47 which expands rapidly and linearly in the direction of extinguishing gas flow as shown by arrow 48. Such a rapidly expanding nozzle construction has the additional advantage of a reduction of blocking of insulating gas flow by the downstream electrode caused by the electrode tip still being within the expanding part of the nozzle during contact separation. The fast expanding nozzle 45 has the detrimental characteristic of producing shock waves by converting directed kinetic energy of the insulating gas into thermal energy within the rapidly flowing insulating gas. Furthermore, the cooling efficiency of the insulating gas will be low due to the low pressure of the gas immediately upon leaving the nozzle 45.

My instant invention achieves arc cooling optimization by contouring the shape of the expanding part of the insulating nozzle, to compromise the two competing requirements, i.e. high expansion rate and high gas pressure, so that optimum recombination is achieved for a given length of the downstream end of the nozzle. Employing the principle illustrated by the equation for nozzle length L, I developed the nozzle shape shown in FIG. 5 for an $SF_6$ puffer breaker. The nozzle itself is made of an insulating material such as carbon tetrafluoroethylene, sold under the trademark Teflon by E. I. du Pont de Nemours and Co., a refractory material, for example, beryllium oxide with an ablative insert at the nozzle throat, or other suitable high temperature insulating material. The nozzle 50 has an upstream portion 51, a throat 52 and a bell-shaped downstream portion 53. The upstream portion 51 is bell-shaped to allow rapid flow of insulating gas over the movable electrode and into throat 52. Downstream portion 53 includes a rapidly expanding section 54 and a flow-confining section 55. Flow-confining section 55 is nearly cylindrical, having an outward taper of 0°–5°, to maintain insulating gas pressure in flow-confining section 55, by preventing spreading in the radial direction and to optimize heat transfer from an arc to the flowing gas. As well as reducing heat transfer, radial spreading of the gas can cause delayed breakdowns, i.e., ionization, of the gas flowing over the arc.

Figure 6:
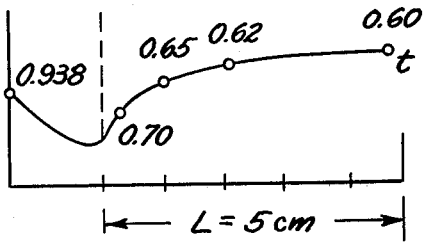
FIG. 6 is a graphical representation of the recombination rate of the nozzle according to the instant invention.
Figure 7:
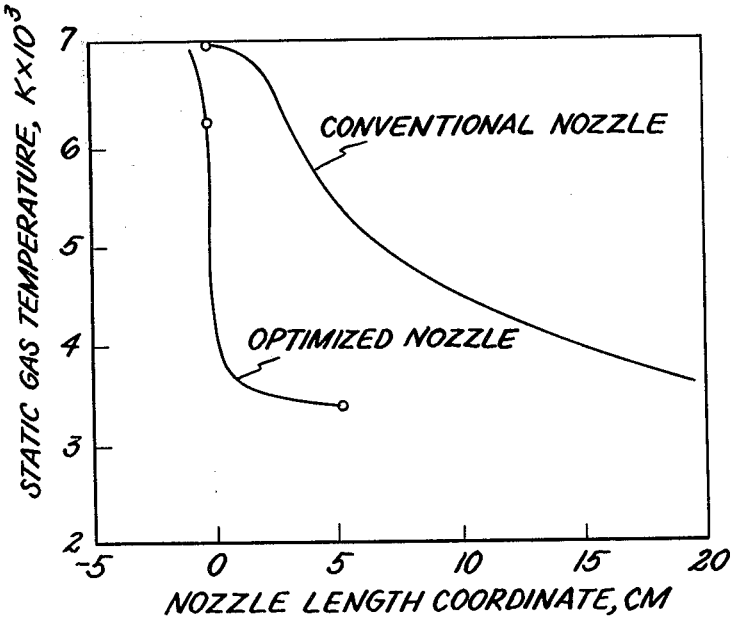
FIG. 7 is a graphical representation illustrating the distribution of static gas temperature relative to nozzle length for the slowly expanding nozzle and for the nozzle of the instant invention.

By providing the rapidly expanding section 54 and the flow-confining section 55 the nozzle 50 of my instant invention provides a means of balancing the competing requirements for successful high voltage arc interruption. As shown in FIG. 6, at a length of 5 centimeters the degree of dissociation is reduced to the level (0.60), which is equivalent to that achieved at a length of 20 centimeters in the slowly linearly expanding nozzle of FIG. 1, as shown in FIG. 3. Therefore, it is clear that with the nozzle of my instant invention a significant increase in arc cooling rate is achieved. Further, the rapidly expanding section 54 allows rapid elimination of ablation material from the nozzle throat 52 thereby deblocking the nozzle of ablation products. There also is no blocking of gas flow through the nozzle by the downstream electrode 14 as the breaker opens, since the nozzle expands rapidly downstream of the throat 52. The presence of ablation products and the blocking of the throat by the downstream electrode, which interfere with successful fast arc interruption in the slowly expanding nozzle, are greatly reduced by the nozzle shape of my instant invention. In FIG. 7 the static gas temperatures in thousands of degrees Kelvin are plotted versus nozzle length for the conventional slowly linearly expanding nozzle shape of FIG. 1 and the nozzle shape of FIG. 5 for a particular test. As shown the optimized nozzle achieves a very rapid temperature drop as compared to the slowly expanding nozzle, clearly showing the improved cooling rate achieved by my novel nozzle construction.

The instant invention also achieves improved arc interruption performance compared to the rapidly, linearly nozzle of FIG. 4. The nozzle 50 of the instant invention is able to maintain insulating gas pressure downstream of the rapidly expanding section 54 at a high enough level to greatly enhance heat transfer from the arc, thereby greatly improving the arc interruption capability of the circuit breaker enabling a breaker employing my instant invention to successfully interrupt high power circuits. The bell-shaped portion of the nozzle 50 immediately adjacent the nozzle throat 52 expands very rapidly and is smoothly curved into the flow-confining section 55. Therefore, even more rapid expansion immediately downstream of the throat is provided, than is achieved with the prior art linearly, rapidly expanding nozzle 45.

As will be appreciated by those skilled in the art my instant invention provides a nozzle construction for a gas-blast circuit breaker having superior arc interruption performance.

I claim:

1. A puffer-type gas-blast circuit breaker comprising:

a pair of separable contacts, said contacts being in abutting engagement when said circuit breaker is carrying normal load current, at least one of said pair of contacts being movable generally axially relative to the other of said pair of contacts to a position separated from the other of said pair of contacts during a high voltage circuit interrupting operation, thereby establishing an arc between said separated contacts;

a nozzle of electrically insulating material disposed concentrically with said contacts, said nozzle comprising an upstream section, a throat section having an internal diameter approximately equal to the outside diameter of one of said contacts which is disposed within said throat when said contacts are in abutting engagement, and a downstream section including a bell-shaped section to provide initial rapid expansion of gases passing through said throat, said bell-shaped section being disposed adjacent said throat and said downstream section also including a substantially cylindrical, flow-confining section downstream of said bell-shaped section to limit further expansion of said gases, said flow-confining section exhibiting an outward taper, in a direction downstream of said throat, of between about 0° and about 5°; and injection means operable during a circuit interrupting operation for forcing a stream of high velocity insulating gas through said nozzle in a generally axial direction, such that said flow of gas passes through said nozzle to surround said arc drawn during said circuit breaker operation, such that said gas passes serially through said upstream section, and said throat and said bell-shaped downstream section.

2. The gas-blast circuit breaker of claim 1, wherein said nozzle is made of carbon tetrafluoroethylene.

3. The gas-blast circuit breaker of claim 2, wherein said flow-confining section of said nozzle has an axial length in the range of 8–20 centimeters.

4. The gas-blast circuit breaker of claim 1, wherein said nozzle is made of beryllium oxide with an annular insert at the nozzle throat of carbon tetrafluoroethylene.

5. The gas-blast circuit breaker of claim 4, wherein said flow-confining section of said nozzle has an axial length in the range of 8–20 centimeters.

6. The gas-blast circuit breaker of claim 1, wherein said rapidly-expanding section is smoothly curved into said flow-confining section.

* * * * *